US010421597B2

(12) United States Patent
Groubert

(10) Patent No.: US 10,421,597 B2
(45) Date of Patent: Sep. 24, 2019

(54) PILL SHELF FLIP CAP CLOSURE

(71) Applicant: Weatherchem Corporation, Twinsburg, OH (US)

(72) Inventor: Brian David Groubert, Boardman, OH (US)

(73) Assignee: Weatherchem Corporation, Twinsburg, OH (US)

( * ) Notice: Subject to any disclaimer, the term of this patent is extended or adjusted under 35 U.S.C. 154(b) by 0 days.

(21) Appl. No.: 14/743,261

(22) Filed: Jun. 18, 2015

(65) Prior Publication Data

US 2015/0368011 A1 Dec. 24, 2015

Related U.S. Application Data

(60) Provisional application No. 62/014,052, filed on Jun. 18, 2014.

(51) Int. Cl.

| | |
|---|---|
| ***B65D 83/04*** | (2006.01) |
| ***B65D 47/04*** | (2006.01) |
| ***B65D 47/08*** | (2006.01) |

(52) U.S. Cl.

CPC ..... *B65D 83/04* (2013.01); *B65D 47/043* (2013.01); *B65D 47/0804* (2013.01)

(58) Field of Classification Search

CPC ... B65D 83/04; B65D 47/043; B65D 47/0804
USPC ..... 220/254.3; 215/235; 222/556
See application file for complete search history.

(56) References Cited

U.S. PATENT DOCUMENTS

| | | | | |
|---|---|---|---|---|
| 6,772,904 | B1 * | 8/2004 | Gilliam | B65D 1/10 220/254.3 |
| 2006/0102649 | A1 * | 5/2006 | Garukyan | G07F 11/44 221/288 |
| 2006/0191933 | A1 * | 8/2006 | Hicks | B65D 47/0804 220/254.3 |
| 2010/0051631 | A1 * | 3/2010 | Blomdahl | B65D 51/247 220/735 |
| 2017/0190503 | A1 | 7/2017 | French et al. | |

* cited by examiner

*Primary Examiner* — James N Smalley
(74) *Attorney, Agent, or Firm* — Amin, Turocy & Watson, LLP

(57) ABSTRACT

The disclosed aspects relate to a closure that includes a lid and a body portion operatively attached to the lid. The closure can include a primary dispensing opening in the body portion and a shelf area adjacent to the primary dispensing opening, wherein the shelf area is configured to hold dispensed product. The closure can also include a secondary dispensing opening above the shelf area and the primary dispensing opening.

14 Claims, 14 Drawing Sheets

PILL SHELF FLIP CAP CLOSURE

CROSS-REFERENCE TO RELATED APPLICATIONS

This application claims the benefit of priority from Provisional Application Ser. No. 62/014,052 filed on Jun. 18, 2014, which is hereby incorporated by reference in its entirety.

TECHNICAL FIELD

The following description relates generally to a closure and more particularly to a flip cap pill closure that has a shelf that facilitates dispensing product.

BACKGROUND

Dispensing closures and associated containers can be utilized with a vast variety of products, which can be in any number of forms (e.g., liquid, powder, solid, as a pill, and so on). Retrieving product from the containers can be difficult at times, and generally requires pouring out the product, especially if the container does not have a wide opening, and the product is not near the top of the container.

SUMMARY

The following presents a simplified summary of one or more aspects in order to provide a basic understanding of such aspects. This summary is not an extensive overview of all contemplated aspects, and is intended to neither identify key or critical elements of all aspects nor delineate the scope of any or all aspects. Its sole purpose is to present some concepts of one or more aspects in a simplified form as a prelude to the more detailed description that is presented later.

An aspect relates to a closure that can include a lid and a body portion operatively attached to the lid. The closure can also include a primary dispensing opening in the body portion and a shelf area adjacent to the primary dispensing opening, wherein the shelf area is configured to hold dispensed product. The closure can also include a secondary dispensing opening above the shelf area and the primary dispensing opening.

In another aspect, the embodiments described herein can include a container assembly that has a container and a closure. The closure can include a lid and a body portion operatively attached to the lid. The closure can also include a primary dispensing opening in the body portion and a shelf area adjacent to the primary dispensing opening, wherein the shelf area is configured to hold dispensed product. The closure can also include a secondary dispensing opening above the shelf area and the primary dispensing opening.

In another aspect, the embodiments described herein can include a closure that has a lid and a body portion. The body portion can be connected to the lid via a hinge, wherein the body portion comprises a shelf area and a dispensing opening adjacent to the shelf area, wherein the shelf area and the dispensing opening are below a top section of the body portion.

To the accomplishment of the foregoing and related ends, one or more aspects comprise features hereinafter fully described and particularly pointed out in the claims. The following description and annexed drawings set forth in detail certain illustrative features of one or more aspects. These features are indicative, however, of but a few of various ways in which principles of various aspects may be employed. Other advantages and novel features will become apparent from the following detailed description when considered in conjunction with the drawings and the disclosed aspects are intended to include all such aspects and their equivalents.

BRIEF DESCRIPTION OF THE DRAWINGS

Various non-limiting embodiments are further described with reference to the accompanying drawings in which.

DETAILED DESCRIPTION

Figure 1:
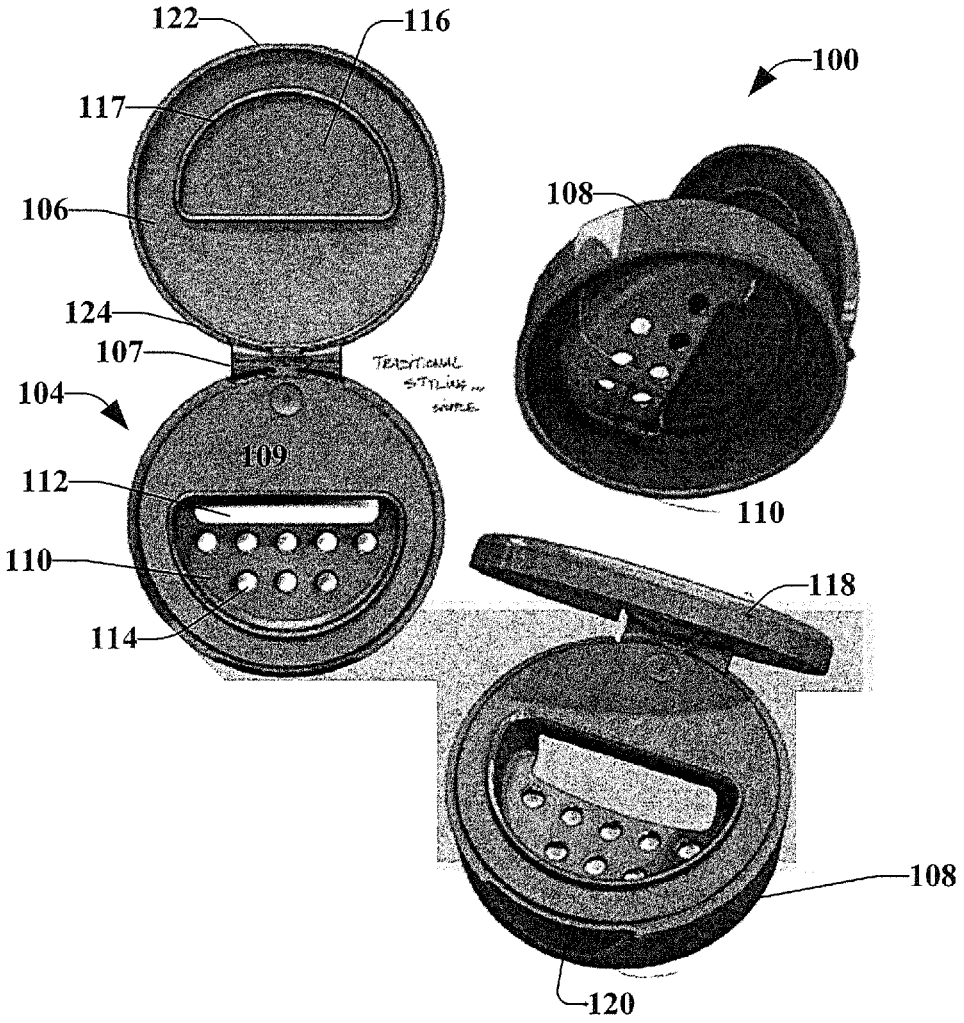
FIG. 1 illustrates example, non-limiting views of an implementation of a closure according to an aspect.

Various aspects are now described with reference to the drawings, wherein like reference numerals are used to refer to like elements throughout. In the following description, for purposes of explanation, numerous specific details are set forth in order to provide a thorough understanding of one or more aspects. It may be evident, however, that the disclosed subject matter can be practiced without these specific details, or with other methods, components, materials, and so forth. In other instances, well-known structures and components may be shown in block diagram form in order to facilitate describing one or more of the aspects disclosed herein.

A closure can be provided that has a shelf area to facilitate dispensing pills and other product from a container. Pills can be deposited on the shelf area from the main container via either shaking or pouring even when the lid of the closure is closed. The shelf area can be adjacent to a primary dispensing opening, and a secondary dispensing opening that provides access to the shelf area can be over the shelf area. The primary and secondary openings can overlap in some embodiments, and in other embodiments the openings can be offset and access to the container can be blocked. The lid can have a raised rim that can fit into the secondary opening and form a seal with the perimeter of the second opening. This can effectively engage the lid and body portion, friction locking the lid and body portion together as well as providing an airtight or water tight seal.

The shelf area can include slots or holes to save on material costs and weight. These slots or holes can be smaller than a diameter or other dimension of the pills so that the pills do not fall through the slots or holes. In some embodiments, the slots or holes can be shaped or sized such that the pills come to rest over the holes, thus assisting with dispensing. The skirt or body portion can have an indented portion (thumb tab) and the lid can have a lip that extends over the indented portion to allow a user to easily raise the lid—even without visual cues.

Turning now to the figures, FIG. 1 illustrates example, non-limiting views of an implementation of a closure 100 according to an aspect. The closure 100 can include a lower section 104 (e.g., body portion) configured to operatively engage a container (not shown). The closure can also include a lid 106 (e.g., a lid portion) in moveable arrangement with the lower section 104. According to an implementation, the lower section 104 can include a skirt 108. In some aspects, the lid 106 can be molded separate from the lower section 104 (e.g., in a two-shot injection molding process) and operatively attached at a hinge 107. According to other aspects, the lid 106 and the lower section 104 can be formed (e.g., during an injection molding process) as a single unit.

The lower section 104 can include a surface area 109 and a shelf area 110 (sometimes referred to as a basket or a similar term) located within a portion of the surface area. The shelf area 110 can be a downward extending shelf area (where downward refers to a direction away from the lid 106 and toward a container (not shown)). The shelf area 110 can be configured to selectively receive product dispensed from the container on which the closure 100 is operatively engaged.

The shelf area 110 can include one or more openings. For example, at least one large opening 112 can be included at a back portion (or other portion) of the shelf area 110, adjacent to the shelf area 110. Further, one or more smaller openings 114 can be included in the shelf area 110. Such smaller openings 114 can be provided to reduce an amount of material used for the shelf area 110, as well as reducing the weight of the closure 100 (e.g., material saver holes).

Located in the lid 106 can be a corresponding or complementary area 116 that can be substantially the same shape as the shelf area 110. For example, if the shelf area 110 is square, the complementary area 116 can be square. In another example, if the shelf area 110 has a straight edge and a curved portion (as illustrated), the complementary area 116 can have a perimeter that includes a corresponding straight edge and corresponding curved portion.

The complementary area 116 located on the underside of the lid 106 can have a downward extending area/rim 117 around its perimeter that can operate as a clean-out or as an extra sealing feature for the shelf area 110, according to an aspect. Thus, when the lid 106 is closed, the downward extending area 117 can form a seal around the shelf area 110.

According to some aspects, the closure 100 can have a traditional styling as compared to other closures. Further, an edge 118 of the lid 106 can have a sharper look (e.g., sharper edge), wherein the edge 118 is less rounded or curved and more angular as compared to other traditional styles of closures. In addition, a thumb tab area 120, which is an indented portion, on the skirt 108 can comprise sharper, well-defined thumb tab features as compared to the other traditional styles of closures.

The thumb tab area 120 can be an indented portion of the skirt, and can be located near a first end 122 of the lid 106. The location of the indented area (or thumb tab area 120) can allow a user to insert a finger, thumb, or other object, under the first end 122 of the lid 106. This can facilitate opening the container by moving the lid 106 from a first position (e.g., a closed position (not shown)), to an open position, as shown in FIG. 1. In an embodiment, the first end of the lid 122 can be slightly extended and/or overhang over the thumb tab area 120.

Thus, the lid 106 can be configured to move from the first position (e.g., a closed position where a lid portion (e.g., the lid) is closed over a body portion (e.g., the lower section 104), to a second portion (e.g., an open position), illustrated in FIG. 1. To move from the first position to the second position, the lid 106 can be moved away from the skirt 108 and lower section 104 at a hinge 107, which can be located at a second end 124 of the lid 106. The second end 124 can be located opposite the first end 122.

As illustrated, when the lid 106 is moved to the second position, the shelf area 110 is exposed (or can be accessed), which allows access to contents within the container. In an example, the shelf area 110 can hold pharmaceutical drugs, tablets, vitamins, or other items that are to be dispensed in a controlled manner.

According to an implementation, the lid 106 and the lower section 104 can be formed during a single injection molding process or during multiple injection molding processes.

Figure 2:
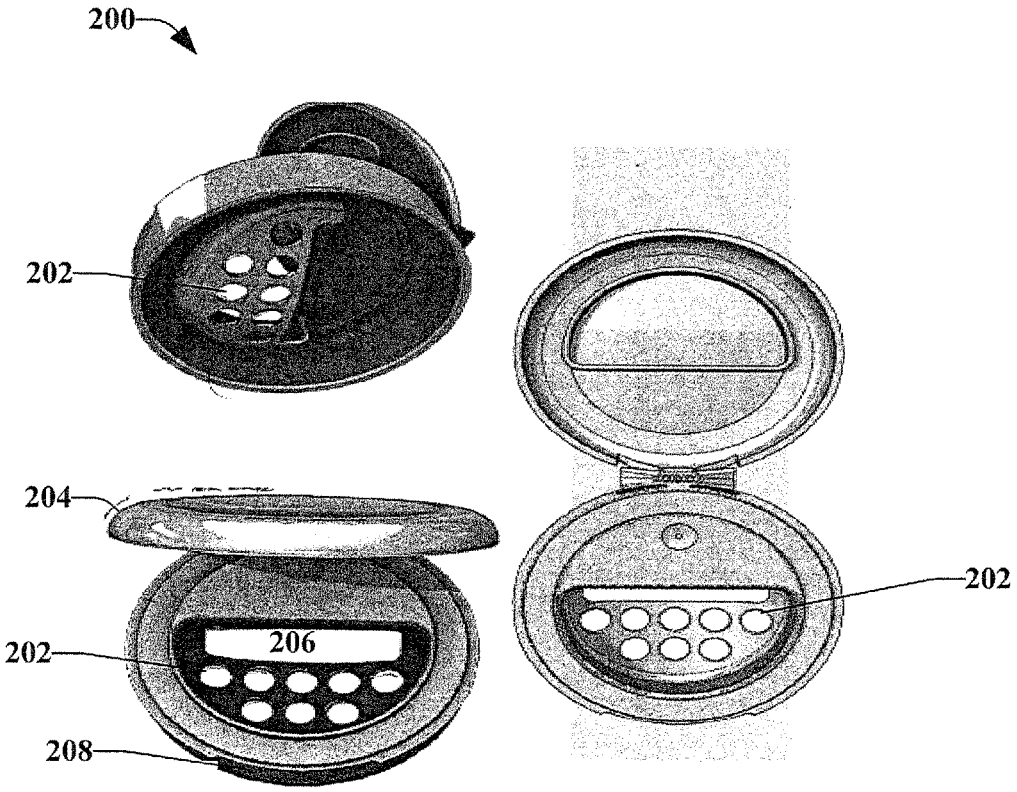
FIG. 2 illustrates example, non-limiting views of an implementation of another closure according to an aspect.

FIG. 2 illustrates example, non-limiting views of an implementation of another closure 200 according to an aspect. The closure 200 is similar to the closure 100 of FIG. 1, and therefore similar elements (which might be identified with similar reference numerals) will not be described again for purposes of simplicity (for this and other figures).

As illustrated the various smaller openings 202 are larger than the smaller openings 114 of the container of FIG. 1. These various smaller openings 202 (smaller as compared to the single large opening 206) can provide further material savings as compared to the closure 100 of FIG. 1.

According to an aspect, the edge 204 of the lid 206 can comprise a softer edge (e.g., more rounded) than the edge 118 of the lid 106 of FIG. 1. According to some aspects, the thumb tab 208 can have sharper-well defined thumb tab features.

Figure 3:
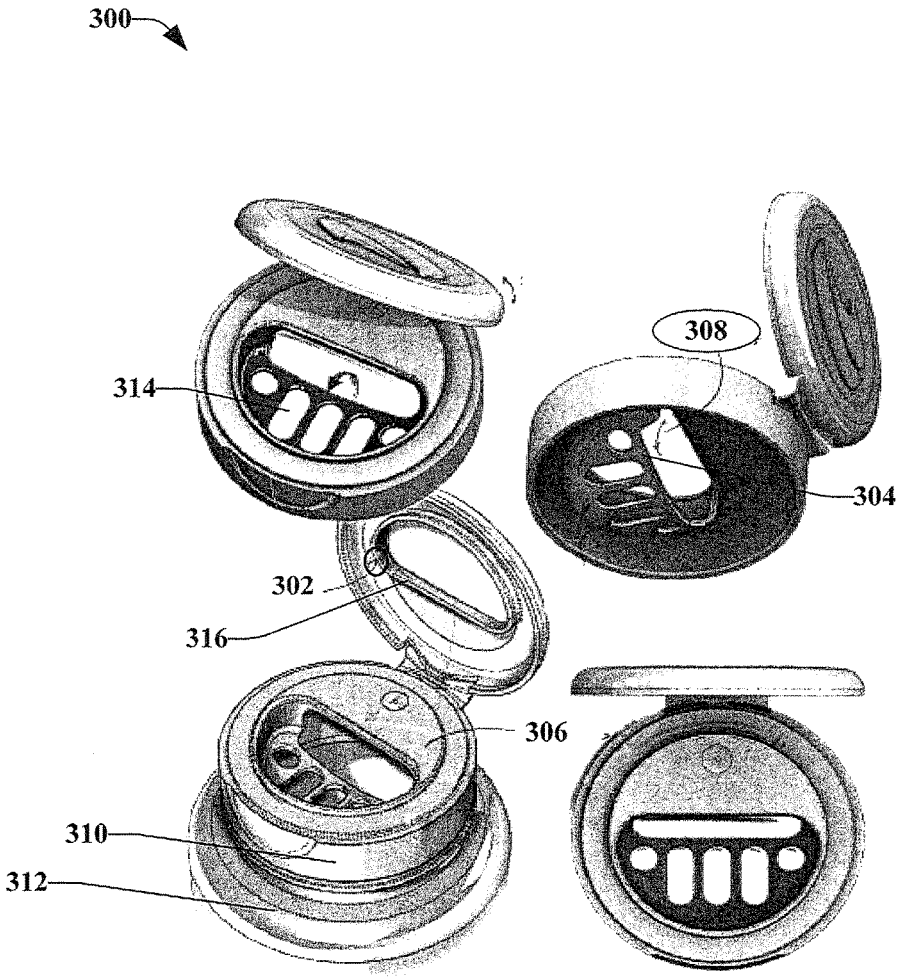
FIG. 3 illustrates example, non-limiting views of an implementation of a further closure according to an aspect.

FIG. 3 illustrates example, non-limiting views of an implementation of a further closure 300 according to an aspect. Similar to the closures illustrated in the above figures, the smaller openings 314 provide weight reducing and material saving features. In this case, the smaller openings 314 can comprise slots and holes. It is noted that although the smaller openings of the various closures are illustrated as comprising rounded edges, the disclosed aspects are not so limited. Instead, the various smaller openings can be other geometric shapes (e.g., triangles, square, rectangles, and so on). Further, different geometric shapes can be utilized for the same shelf area, such as the smaller openings 314 (e.g., a single container can have two or more shapes for the openings).

As illustrated in FIG. 3, the closure can include a skirt 310, which can operatively engage a container 312 in a reversible (e.g., can be removed) or an irreversible manner (e.g., cannot be removed).

According to an implementation, the edge of the lid can comprise a softer edge, as compared to the previous figures.

In some implementations, the shelf area 304 can be a soft, countered shelf, as illustrated at view 308. Further, according to some implementation the surface area (sometimes referred to as a deck (can be raised and, thus, can be a full raised deck 306.

As illustrated by the circled portion 302, internal seal beads can be formed on the perimeter of the complementary area of the downward extending area 316. The internal seal beads can provide sealing features around an outside perimeter of the shelf area 310.

Figure 4:
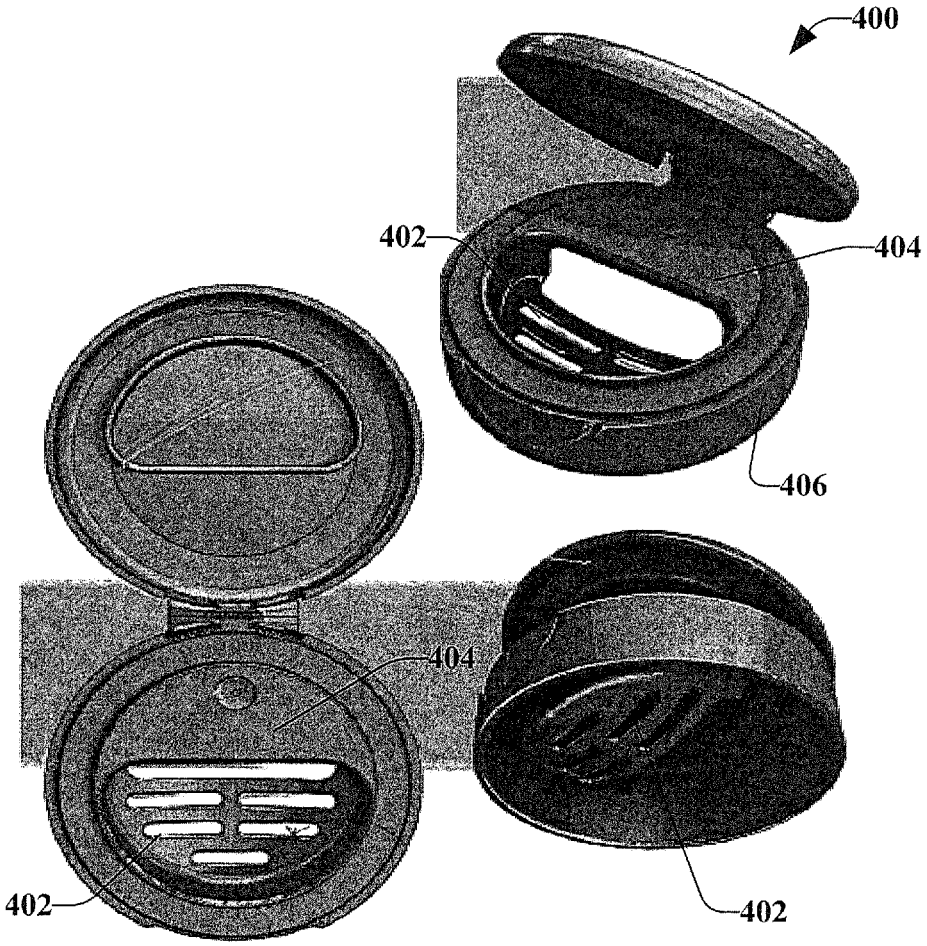
FIG. 4 illustrates example, non-limiting views of an implementation of still another closure according to an aspect.

FIG. 4 illustrates example, non-limiting views of an implementation of still another closure 400 according to an aspect. As illustrated, the one or more smaller openings 402 can comprise linear pattern slots for weight reduction (and for the use of less material to manufacture the closure 400). Additionally or alternatively, the thumb tab area can be deeper, as measured from the surface area 404 to a bottom of the skirt 406 (e.g., in a direction toward a container (not shown)).

Figure 5:
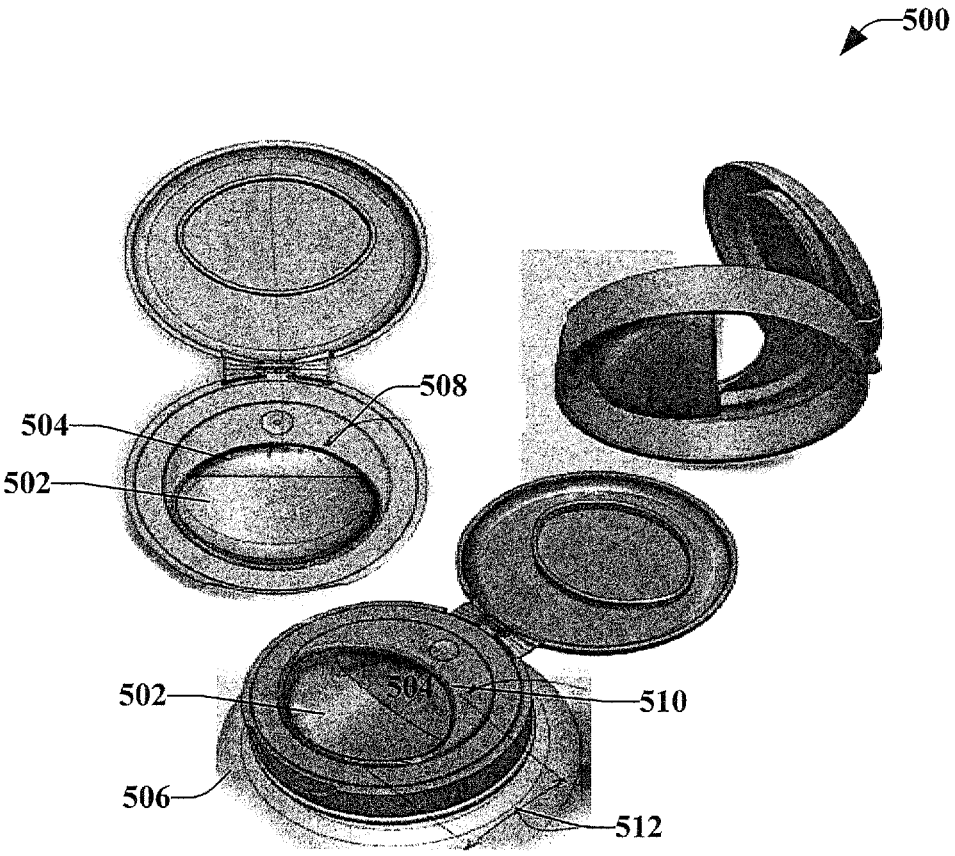
FIG. 5 illustrates example, non-limiting views of an implementation of yet another closure, according to an aspect.

FIG. 5 illustrates example, non-limiting views of an implementation of yet another closure 500, according to an aspect. According to this implementation, the shelf area 502 does not include the smaller openings, but does include the large opening 504 to allow product to be dispensed. As discussed herein, the product is dispensed through the large opening 504 and can remain on the shelf area 502 until a user picks up the product, or the product is returned to the container 506 through the large opening 504. As illustrated at 508, the large opening 504 can comprise a curved edge.

Similar to the closure 400 of FIG. 4, the closure 500 comprises a raised deck surface 510. In this implementation, the shelf area comprises a larger opening 512) as compared to the shelf areas of the previous figures.

Figure 6:
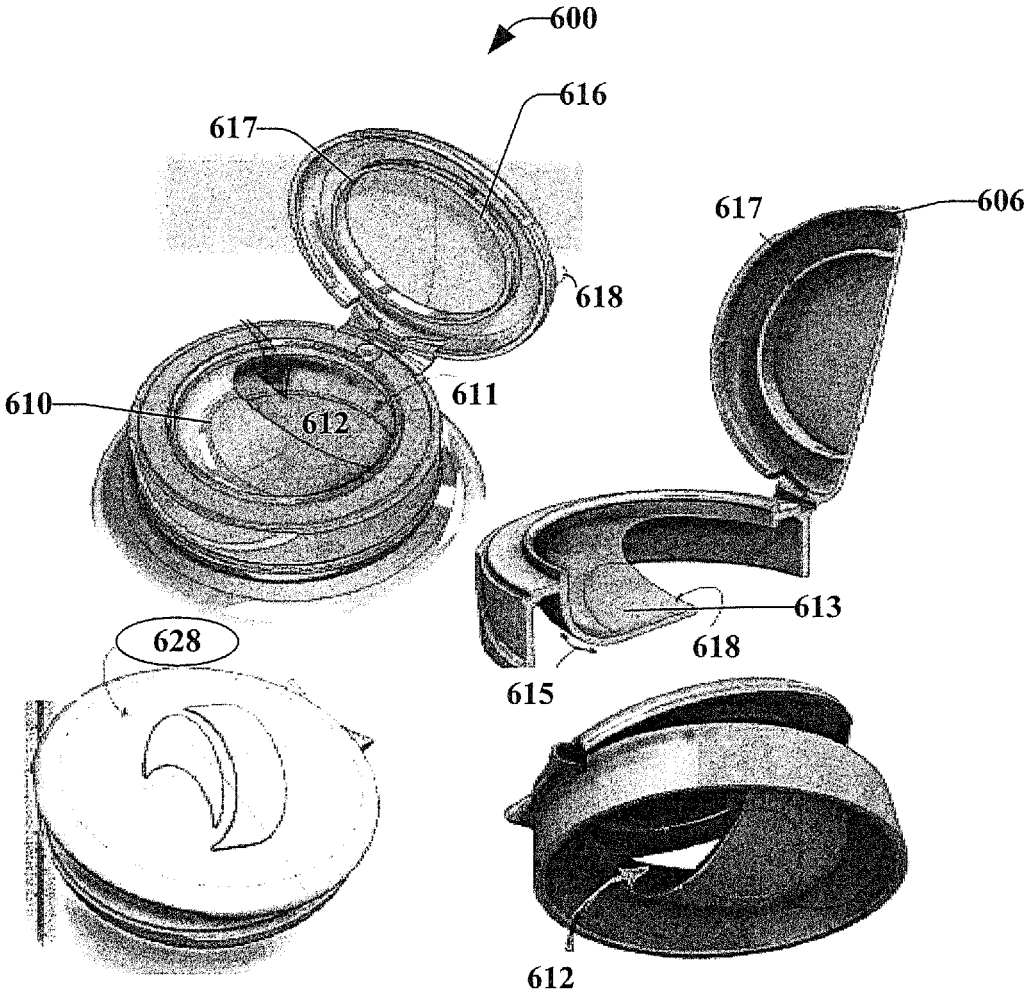
FIG. 6 illustrates example, non-limiting views of an implementation of another closure, according to an aspect.

FIG. 6 illustrates example, non-limiting views of an implementation of another closure 600, according to an aspect. In this implementation, the large opening 612 can be big enough for a user to insert one, two, or more fingers through the large opening 612. As illustrated the opening can be a full-round opening 611. Further, the large opening 612 can be wide for large sized tablets, or other products.

According to some implementations, the downward extending portion 617 of the complementary area 616 can comprise a full round seal configured to engage an outer perimeter of the shelf area 610.

The shelf area 610 can have a bottom surface 613 that comprises a solid fill (e.g., no openings), according to an implementation. In some aspects, an underside 615 of the shelf area 610 can comprise an easy-grab corner radius. This radius can facilitate dispensing of the product.

Additionally or alternatively, the edge 618 of the lid 606 can comprise a domed surface. In an aspect, the domed surface can comprise a soft edge radius. In some implementations, as illustrated at 628, the top surface of the lid 606 can comprise an area for placement of a logo, design, or other feature.

Figure 7:
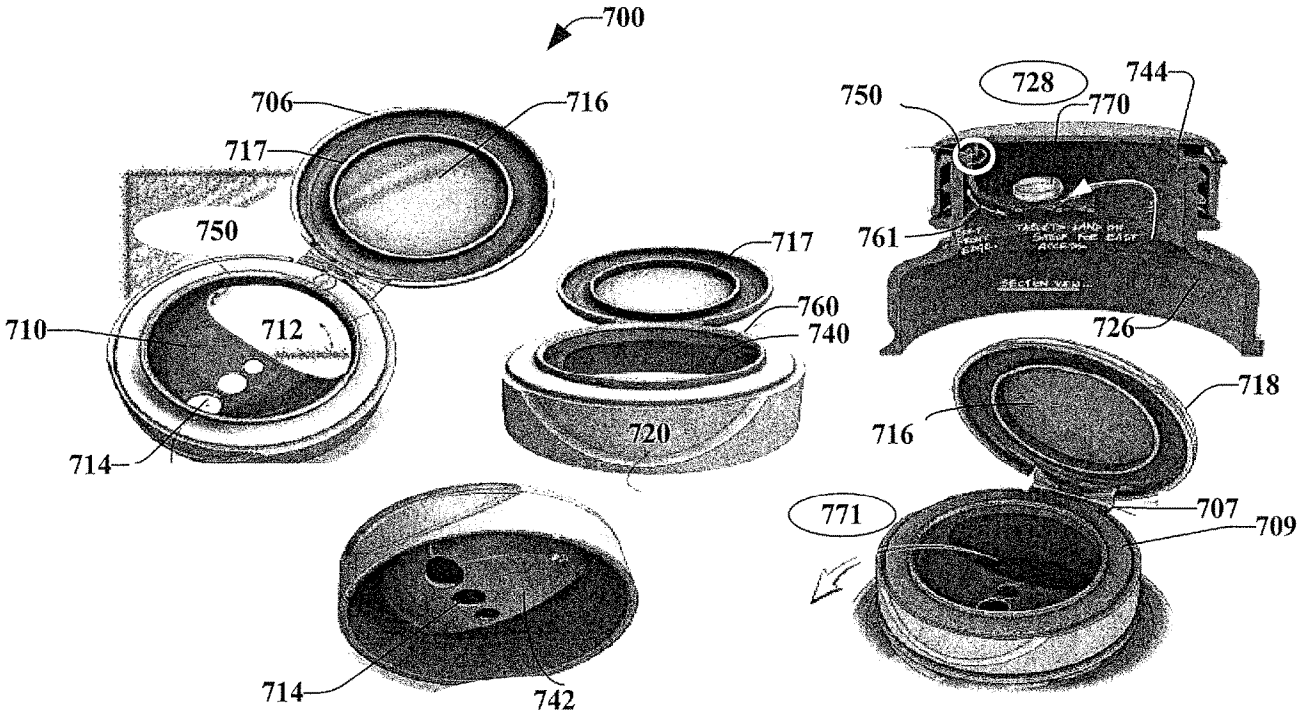
FIG. 7 illustrates example, non-limiting views of an implementation of a further closure, according to an aspect.

FIG. 7 illustrates example, non-limiting views of an implementation of a further closure 700, according to an aspect. As illustrated in this embodiment, the shelf area 710 comprises a large opening 712 and one or more smaller openings 714. The large opening 712 can comprise soft corner transitions 750. Additionally or alternatively, the large opening 712 can be a large opening for the pill shelf. The illustrated one or more smaller openings 714 can be design feature holes (e.g., for aesthetic reasons). According to some implementations, the one or more smaller openings 714 can be utilized for material savings (and weight reduction). In some implementations, the closure can be a 30 mm-400 size. However, the disclosed aspects are not limited to this size and this size is provided for explanation purposes only.

In some implementations, the thumb tab 720 can be an over-sized thumb tab, as compared to the previous figures. Additionally or alternatively, an underside 742 of the shelf area 710 can comprise a smooth finish or smooth shelf feature.

The hinge 707 can be a full strap hinge, according to an aspect. Further, the underside of the lid 706 (e.g., the complementary area 716) can comprise a domed surface.

The mouth 740 of the closure 700 can be wide, which can be utilized to maximize an opening size. In this implementation, the mouth 740 can be substantially the same size as a mouth of a container 726, as illustrated at the section area view at 728.

In some implementations, one or more seal surfaces 744 can be located between a downward extending portion 717 of the complementary area 716 and an upward extending portion 760 of the shelf area 710. Additionally or alternatively an underside of the shelf area 709 can comprise a soft front edge 761

With continuing reference to the section area view at 728, a tablet 770 can (e.g., when the container assembly is at least partially inverted) flow from the container 726 and land at the illustrated position on the shelf area 710 (following the direction of the arrow at view 728 and the arrow at view 771) for easy access by a user.

Figure 8:
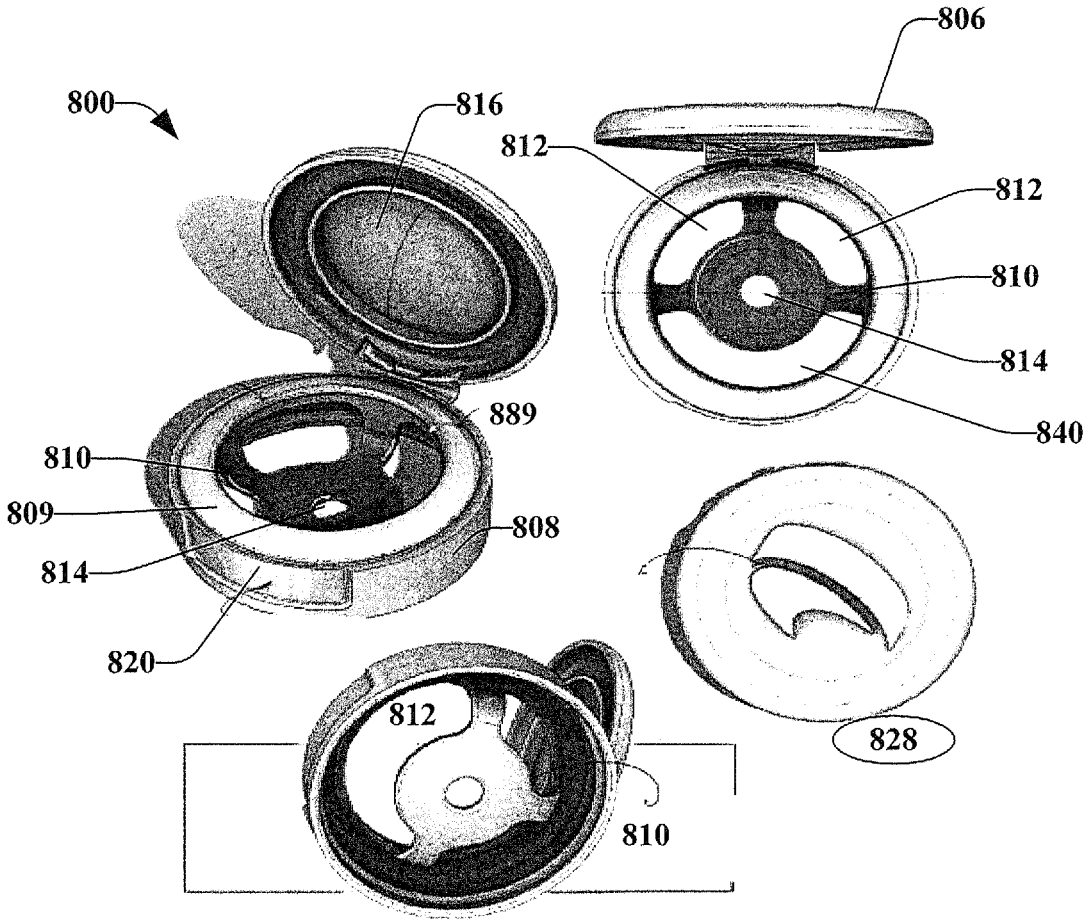
FIG. 8 illustrates example, non-limiting views of an implementation of a closure, according to an aspect.

FIG. 8 illustrates example, non-limiting views of an implementation of a closure 800, according to an aspect. In this implementation, a shelf area 810 (also referred to as a tablet shelf) comprises multiple large openings 812 and one or more smaller openings 814. The smaller openings 814 can be utilized to reduce a weight of the closure, as well as conserving material. The multiple large openings 812 (three of which are illustrated) can be the same size or different sizes. Further, the multiple large openings 812 can be located around a perimeter of the shelf area 810. The tablet or other product that is dispensed can flow through one of the multiple large openings 812 and rest on the smaller opening 814 of the shelf area 810. Thus, the illustrated shelf area, or shelf area 810, comprises a simple configuration that allows product an easy path for dispensing.

A surface area 809 of the closure 800 can be maximized for full opening dispensing capabilities. For example, the surface area 809 can be smaller (in terms of width) as compared to other implementations. Thus, a mouth 840 of the closure 800 can be about the same size as a mouth of the container (not shown). In a specific example, the mouth 840 can be a 38 mm opening, however, the disclosed aspects are not limited to this example.

In some implementations the surface area 809, as illustrated at 889, can be formed of an ultra-soft material. Further, the surface area can be formed using a round edge treatment, according to an implementation.

An underside of the lid 806, which includes the complementary area 816, can comprise a bubble-shaped surface. In this case, a lower or underside of the lid 806 extends slightly downward and, at least partially, into the shelf area 810 when the closure is in a closed position.

A thumb tab 820 on a front area of the closure 800 can comprise a straight, linear (e.g., rectangular) appearance, according to some aspects. It is noted that various aspects discussed herein can be utilized with other aspects (e.g., the thumb tab 820 of FIG. 8 can be incorporated into the closure 300 of (FIG. 3).

As illustrated at the top view 828, a top surface of the lid 806 can comprise a deeper embossed or molded logo surface. However, according to other aspects, the top surface can be smooth or can include other geometric designs and/or shapes.

Figure 9:
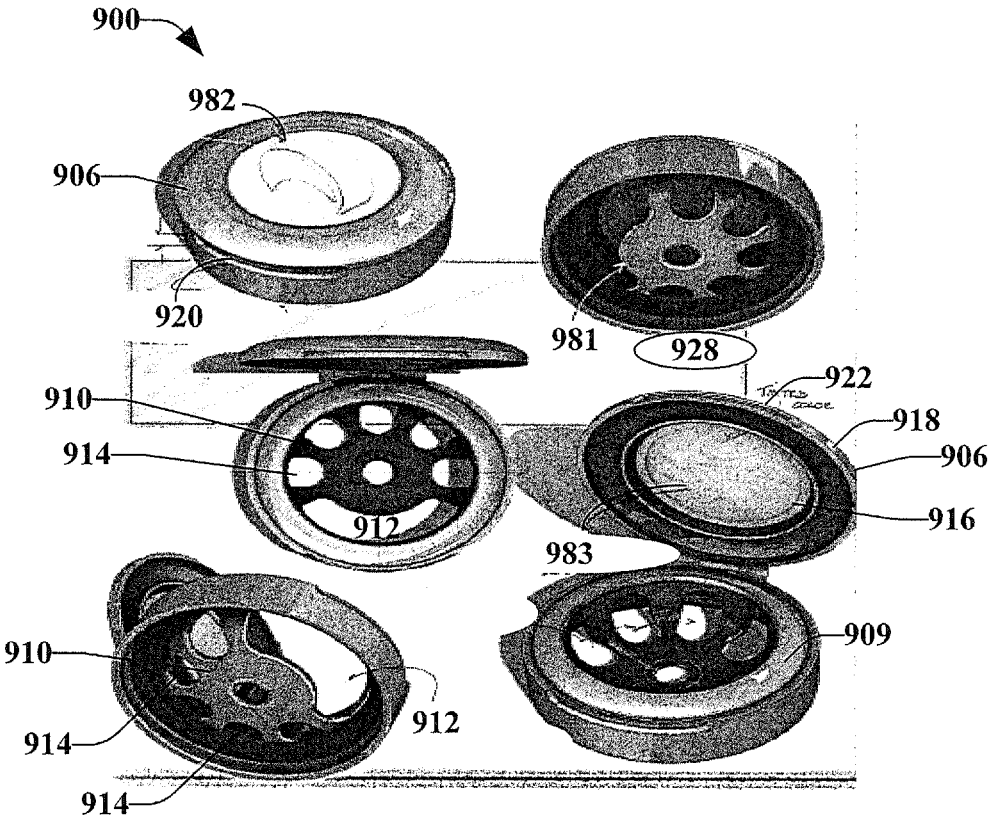
FIG. 9 illustrates example, non-limiting views of an implementation of another closure, according to an aspect.

FIG. 9 illustrates example, non-limiting views of an implementation of another closure 900, according to an aspect. In this implementation, the surface area 909 comprises a large opening 912 and multiple smaller openings 914. The large opening 912 can be formed on the front of the closure 900. Further, the large opening 912 can be configured as a tablet dispensing opening. As illustrated by the bottom view 928, the large opening 912 can comprise a soft edge 981.

According to the illustrated implementation, the multiple smaller openings can extend upward toward an upper surface or toward and edge 918 of the lid 906. Further, a distance between the multiple smaller openings 914 can be smaller, as compared to other implementations. The smaller or shorter distance can provide a tighter basket (e.g., shelf area 910) configuration, according to an aspect.

An underside of the lid 906 (e.g., a complementary area 916) can be formed of a different color than the other portions of the closure 900. For example, the complementary area 916 can be formed of a tinted color. Further, as illustrated the complementary area 916 can extend to a top surface of the closure 900, wherein a marking 982 (e.g., a logo) can be shown on the inside of the lid (at 983). The marking 982 can be formed as a semi-transparent top surface. According to some aspects, the marking 982 can be formed during a co-injection process.

A thumb tab 920 formed near a first end 922 of the lid 906 can be formed as a narrow feature. This narrow thumb tab can give the closure a low-profile appearance.

Figure 10:
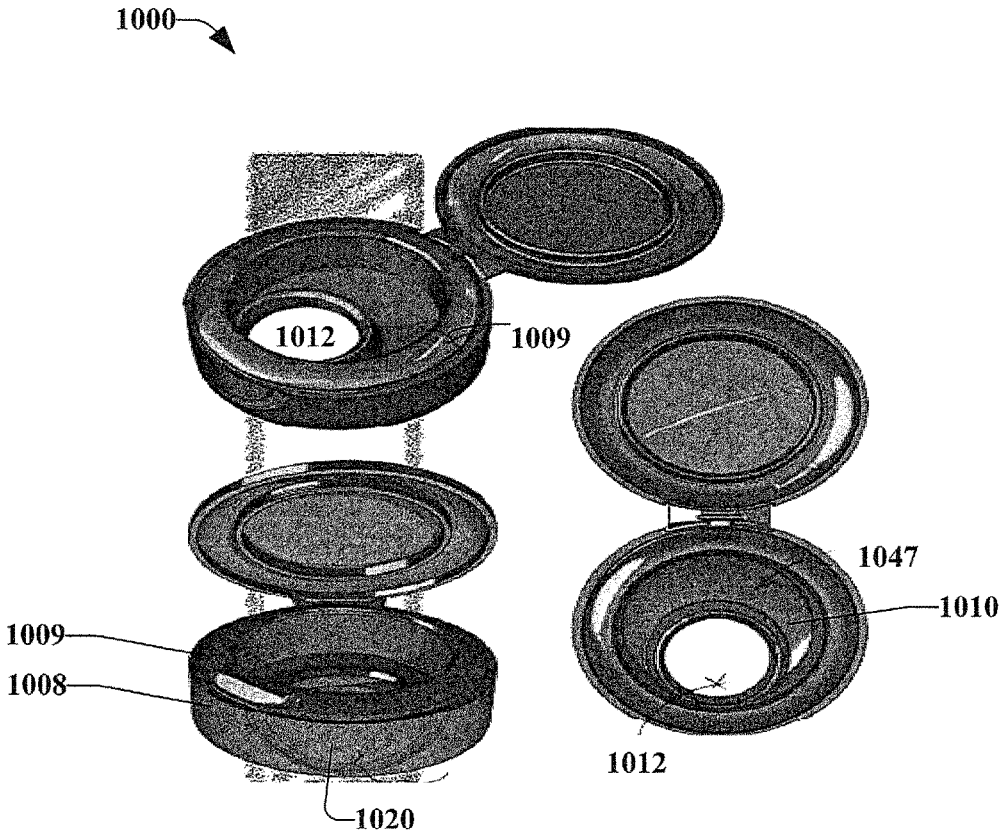
FIG. 10 illustrates example, non-limiting views of an implementation of a further closure, according to an aspect.

FIG. 10 illustrates example, non-limiting views of an implementation of a further closure 1000, according to an aspect. In this implementation, the thumb tab 1020 is a larger thumb tab, as compared to other closures discussed herein. According to some implementations, the surface area 1009 comprises a soft edge. The soft edge can be formed by rounding the surface area 1009.

The shelf area 1010 is illustrated as a tablet pocket 1047. The tablet pocket 1047 can extend farther down into the skirt 1008. According to some implementations, a bottom of the skirt 1008 and a bottom of the tablet pocket 1047 are at approximately the same level.

Further to this implementation, the large opening 1012 is located at the front of the housing. The large opening 1012 is illustrated as a round dispensing opening. However, the disclosed aspects are not limited to this implementation and other shapes can be utilized for the dispensing opening.

Figure 11:
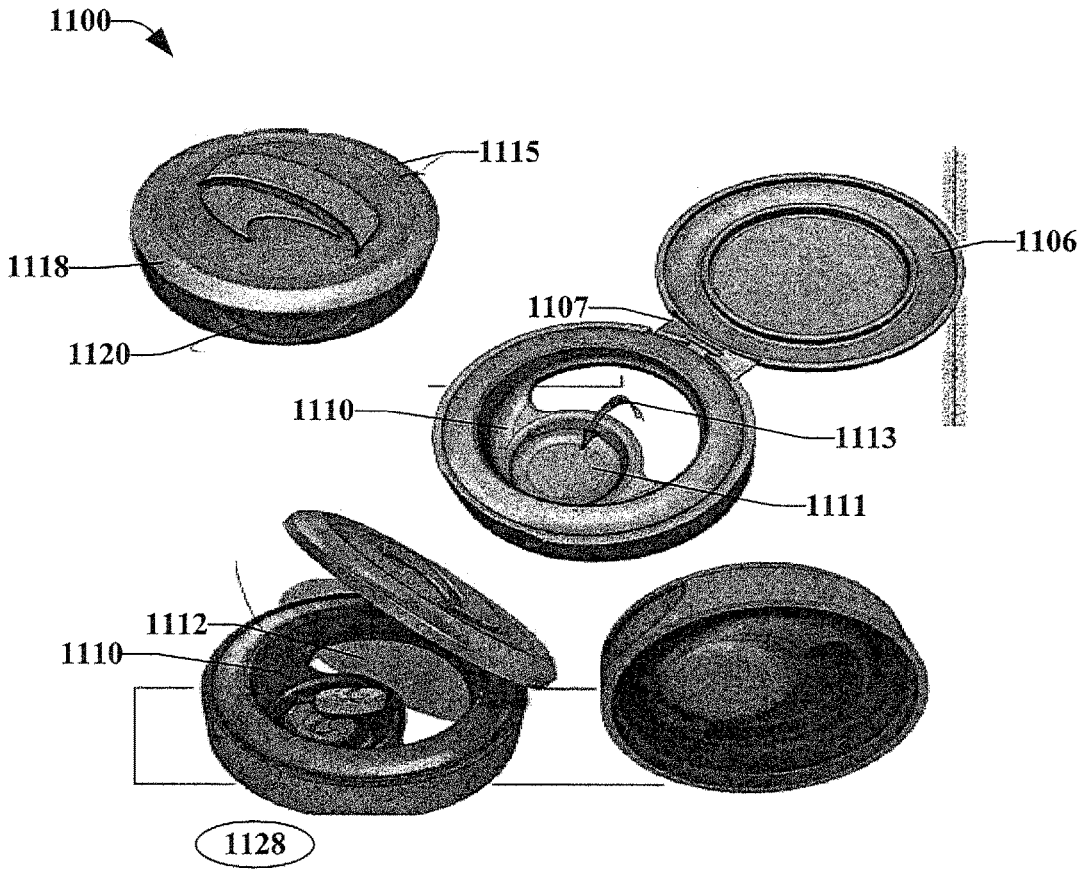
FIG. 11 illustrates example, non-limiting views of an implementation of still another closure, according to an aspect.

FIG. 11 illustrates example, non-limiting views of an implementation of still another closure 1100, according to an aspect. In this implementation, the large opening 1112 is located at a back of the closure (e.g., near a hinge 1107, or near multiple hinges). The shelf area 1110 comprises a pocket or bowl 1111 that can be configured such that a pill (tablet or other product), after being dispensed through the large opening 1112 (depicted by arrow 1113), falls into the bowl 1111. The tablets in the bowl 1111 are illustrated at view 1128. The user can scoop the pill out of the bowl 1111, which eliminates the need for the user from placing her fingers into the container (which can contaminate the container contents).

According to various implementations, the bowl 1111 can be sized differently for different sized pills. For example, for larger pills (e.g., vitamins, tablets, and so on), the bowl can be sized larger than the size for smaller pills. Further, the shape of the bowl 1111 can be selected based on a shape of the product (e.g., pill, table, aspirin, and so on).

It is noted that although the illustrated thumb tab 1120 is a standard size, other sizes can be utilized. Further, the outside of the lid 1106 is illustrated with a wide logo surface 1115 that wraps to a bevel edge (at the edge of the lid 1118).

Figure 12:
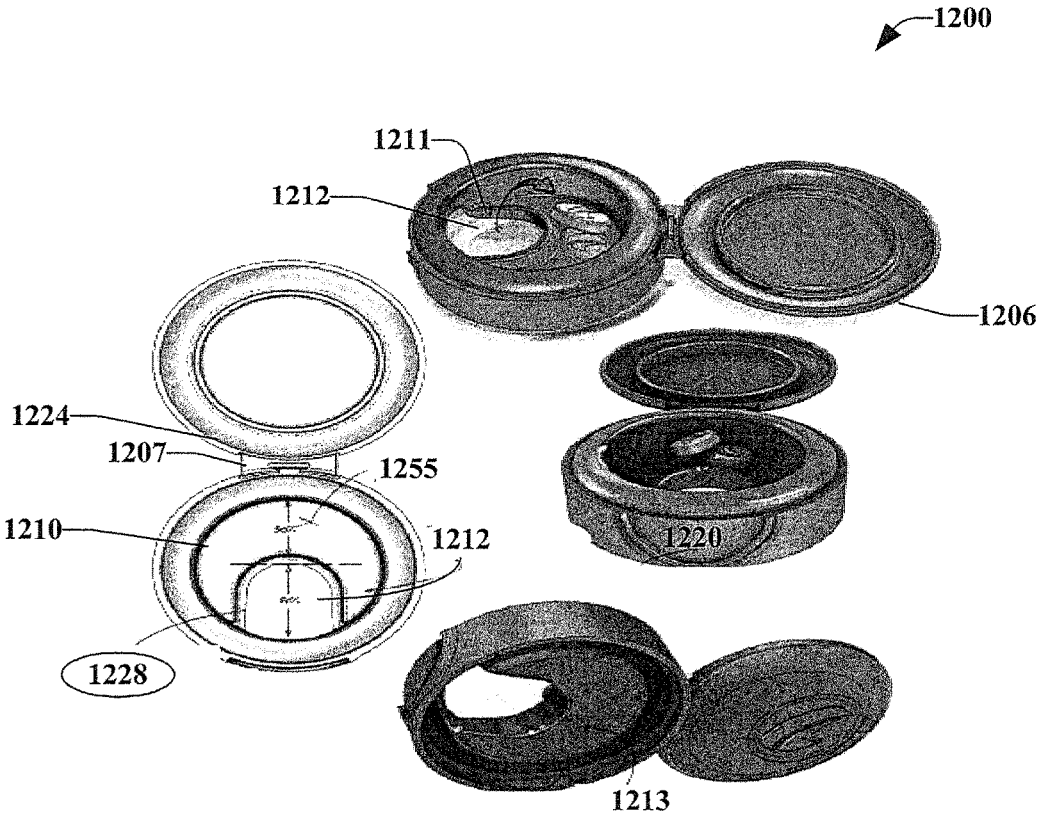
FIG. 12 illustrates example, non-limiting views of an implementation of yet another closure, according to an aspect.

FIG. 12 illustrates example, non-limiting views of an implementation of yet another closure 1200, according to an aspect. In this implementation, a raised lip 1211 (e.g., extending in a direction upward, toward the lid 1206) can be formed around the dispensing opening 1212. Product is shown dispensed and resting in the shelf area 1210. For example, the product (illustrated as tablets) can rest on the back platform 1255 of the shelf area 1210.

According to an implementation, the bottom or underside of the shelf area can be smooth, as illustrated at 1213. According to some implementations, the thumb tab 1220 can be more sharply defined, which could give the thumb tab 1220 a bold, or ultra-enhanced appearance.

In this implementation, the dispensing opening 1212 is illustrated as a "U" shaped opening, which is another configuration that can be utilized by any of the embodiments discussed herein. As illustrated at 1228, a diameter of the shelf area 1210, measured from a front of the closure to a back of the closure (e.g., an area near the hinge 1207) can be divided evenly (e.g., fifty-fifty) between the dispensing opening 1212 and the back platform 1255. However, in other implementations, the division can be different, such as forty-sixty, thirty-seventy, and so forth.

Figure 13:
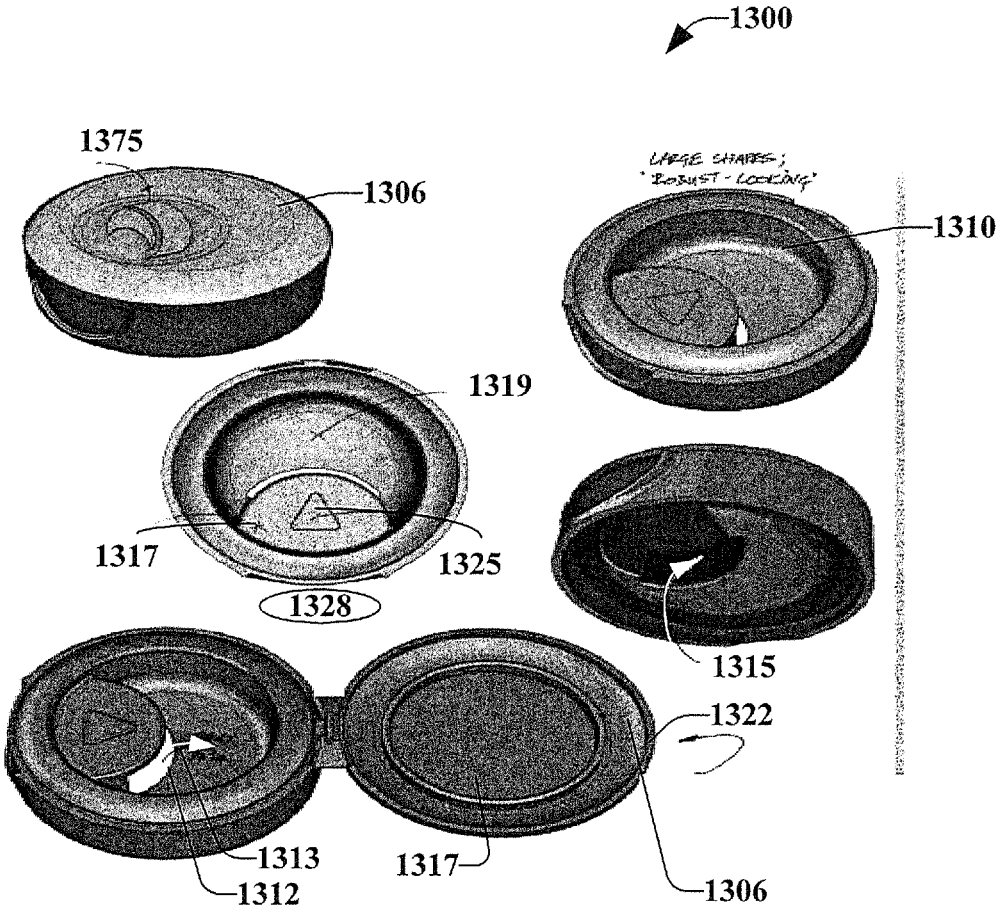
FIG. 13 illustrates example, non-limiting views of an implementation of still another closure, according to an aspect.

FIG. 13 illustrates example, non-limiting views of an implementation of still another closure 1300, according to an aspect. A tablet path from the dispensing opening 1312 (or large opening) to the shelf area 1310 (also referred to as tablet pocket) is illustrated by arrow 1313 and arrow 1315.

A top view of the shelf area 1310 is illustrated at 1328. In various implementations, a roof barrier 1317 can be placed over the dispensing opening 1312. The roof barrier 1317 can protect the dispensing opening 1312 and can prevent external objects from falling into the container (not shown) through the dispensing opening. As illustrated, an interior logo or emblem 1319 can be formed (or placed) on an upper surface of the roof barrier 1317. The large shapes of the shelf area 1310 and roof barrier 1317 can give the closure a robust appearance. According to some aspects, a logo 1375 can be placed on an outside surface of the lid 1306. For example, the logo 1375 can be offset from a center of the closure 1300.

According to some aspects, the hinge can be located on an opposite side (e.g., adjacent the dispensing opening 1312 and roof barrier 1317 (indicated by arrow 1325)). Such placement of the hinge at this side can provide controlled, directional dispensing.

Figure 14:
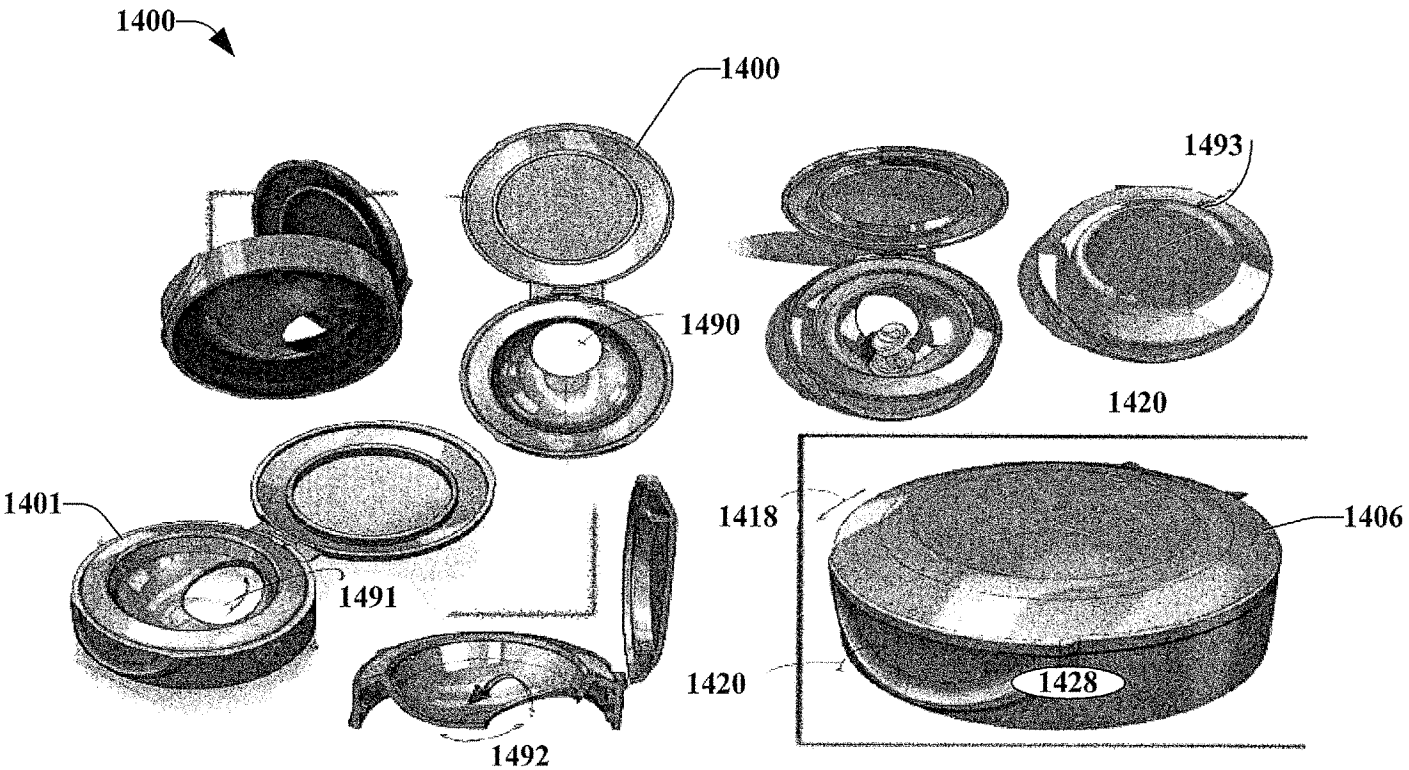
FIG. 14 illustrates example, non-limiting closures according to various aspects.

FIG. 14 illustrates example, non-limiting closures according to various aspects. A circular dispensing hole 1490 is illustrated in a top view of an example closure 1400. Another closure 1401 is illustrated having an elliptical shaped dispensing hole 1491. The closure 1400 and the closure 1401 can comprise a deep dish 1492 as the shelf area.

In some implementations, the closure can comprise a long bevel edge 1418 on the outside perimeter of the lid 1406. Further, a thumb tab 1420 can comprise square angular features. As illustrated at 1428, the thumb tab 1420 can be distinct to allow a user to easily distinguish a front edge of the closure (to assist in knowing where to open the closure). A top surface of the lid 1406 can comprise a larger graphic logo area, surrounded by a soft edge, depicted at 1493.

Although the illustrated closures have a particular size and shape, the disclosed aspects are not limited to these embodiments. Instead, the closure(s) can be any size or shape and the closures illustrated are for example purposes only. Further, the container(s), on which the closure(s) can be operatively attached, can also be any shape or size, which can be selected as a function of contents or product that is to be stored in the container. Examples, of container contents can include powder, granular items, solid or semi-solid contents including food items (e.g., ketchup, mustard, baby food, spices, cookies, cereal, peanuts, grains, and so forth) and non-food items, such as hardware (e.g., nuts, bolts, nails, fasteners, screws) as well as other items (e.g., rock salt, grass seed, sand, and so on). In another example, the container contents can be liquid or semi-liquid contents (e.g., water, orange juice, automotive oil, rubbing alcohol, and so forth). Other examples of container contents can include medicine (e.g., pharmaceutical products) and cosmetics. The container contents that can be utilized with the disclosed aspects are many and, therefore, will not be further discussed herein.

The closure(s) and container(s) can be the same color or can be different colors. For example, the container(s) can be clear and the closure(s) can be colored (opaque). In another example, both the container(s) and the closure(s) can be clear. In accordance with some aspects, the closure(s) and the container(s) can be made of the same material or of a similar material. According to other aspects, the closure(s) and the container(s) are formed of different materials. In an implementation, the container(s) and/or the closure(s) can be formed of a polymer material. According to some implementations, the closure(s) and/or the container(s) can be formed of an injection molded suitable thermoplastic material (e.g., polymer, polypropylene) or other material known in the art.

The closure(s) may be illustrated as a unitary (e.g., a one-piece) structure having a first portion (e.g., a body portion) configured to engage the neck of the container(s) and a second portion (e.g., a lid portion) configured to be movable with respect to the first portion. In accordance with some aspects, the dispensing closure(s) can be formed as a multiple piece structure, wherein the body portion and the lid portion are operatively connected at a hinge. As previously mentioned, although the various aspects are illustrated as a generally circular dispensing closure(s) and/or container (s), the various aspects are not limited to this implementation. In accordance with some aspects, the dispensing closure(s) and/or container(s) can have a different geometric shape (e.g., oval, oblong, and so on).

As mentioned, the lid portion can be movable. For example, the lid portion can be configured to move between a first position (e.g., closed position) and a second position (e.g., open position). For example, the lid portion can be configured to selectively engage the body portion or top (e.g., first position or closed position) and can be further configured to move away from the body portion (e.g., second position or open position). When the lid portion is in the open position, contents (not shown) of the container can be accessed or dispensed.

In an implementation, the lid portion can be configured to, at least temporarily, seal the container such that contents of the container cannot be accessed. Thus, the closure can be moved into its first position for spill-proof purposes and/or for safety purposes (e.g., seals the product within the container, provides an indication that contents of the container might have been tampered with, and so forth). Further, the movable lid portion can be configured to provide easy access to the container and container contents (e.g., through a flip open feature), wherein container contents can be accessed without completely removing the closure from the container.

The container, on which the closure is operatively attached, can include an opening or container mouth. The closure (e.g., body portion, skirt, sidewall, and so on) can be configured to engage a neck (e.g., an upper rim) of the container, wherein the container neck comprises an outer boundary or outer perimeter of the mouth. When in engagement with the container, an opening of the top corresponds to the container mouth such that container contents can be dispensed through the container mouth and the opening.

According to an aspect, the body portion comprises an end wall. According to some aspects, the end wall can be generally circular; however, other configurations are possible with the disclosed aspects. A hollow or tubular skirt depends from the end wall. The skirt can be generally cylindrical or a different shape, which can be a function of the shape of the end wall.

The skirt can be configured to engage with the container. For example, the skirt can engage with a mouth of the container in a threaded manner or in a non-threaded manner. For example, the skirt can include internal screw threads that can operatively engage with complementary screw threads on a neck of the container. According to some aspects, internal threads are not utilized and the dispensing closure is engaged with the container through other means (e.g., snap-on, press-on, and so forth). For example, the closure can operatively engage the container by snapping onto the neck portion of the container (e.g., screw threads are not utilized). However, other means of engaging the closure and the container can be utilized with the disclosed aspects. In an aspect, the container and closure can be a two-piece structure. According to some aspects, the container and the closure are formed as a single piece or single unit. Further, the dispensing closure can engage the container in a removable manner or in a non-removable manner. When snapped together, the closure can be utilized to eliminate the use of a liner, according to an aspect.

An exterior portion of the skirt can be smooth. In another implementation, an exterior portion of a skirt can comprise small vertical grooves or other textural features that can improve a person's ability to grip the dispensing closure for removal from the container (e.g., by unscrewing, by pulling the dispensing closure away from the container, and so on).

A dispensing closure can be installed upright on the top of a container that has a mouth that typically lies in a horizontal plane. For purposes of discussion, the vertical direction generally corresponds to an axial direction with reference to the geometry of the dispensing closure and the horizontal direction or horizontal plane is perpendicular to the axial direction of the dispensing closure (e.g., the vertical direction). It should be understood that during molding, the dispensing closure could have a non-upright orientation.

The lid portion (or lid) can be pivotally joined to the end wall (or the top) by, for example, the hinge. The hinge can be a "living hinge", a "pivoting hinge", or another type of hinge. A living hinge is a hinge formed with the body portion and the lid portion as a single piece. A pivoting hinge is formed with the body portion (or the lid portion), wherein the body portion and lid portion are formed as separate pieces and snapped together at the hinge to combine the two pieces. The hinge lies in a plane perpendicular to the axis of the skirt. The hinge allows for ease of moving the lid portion, between the first position and the second position. When in the first position, the lid portion is closed over the body portion and product cannot be dispensed from the container (e.g., for storage purposes). When in the second position, the lid portion is "open" (or moved away from the body portion), which allows product to be dispensed in a full-open manner (e.g., an end user can insert their hand into the container to dispense product.

According to some aspects, the hinge can be constructed of a relatively thin wall that is configured to flex without breakage during an expected service life of the dispensing closure. The hinge allows the lid portion to be moved away from the body portion (e.g., flipped up, placed into the second position) for dispensing in a "full open" manner. The hinge also allows the lid portion to be moved into contact with the body portion (e.g., placed into the first position) for dispensing in a non-full open manner (e.g., in a pourable manner) or for storage purposes.

As discussed above, the size of the container and the container mouth (e.g., portion of the container to which the dispensing closure engages) can be a function of the size of the contents to be stored in the container. If the contents are large or should be dispensed in large quantities, the container, the container mouth, and the dispensing closure can be large. On the other hand, if the contents are small and/or should be dispensed in small quantities, the container mouth and dispensing closure can be small.

Further, the dispensing closure can include components, such as a flap or lid (e.g., lid portion) that can be flipped away from a main portion (e.g., body portion) of the dispensing closure in order to access contents of the container. The flipping or pivot action can provide access to the container contents without the need to completely remove the dispensing closure from the container (e.g., allowing access to the container contents with minimal effort).

Appendix A is a fourteen page document describing various aspects and features associated with particular aspects of a closure. This appendix is to be considered part of the specification.

The subject matter as described above includes various exemplary aspects. However, it should be appreciated that it is not possible to describe every conceivable component or methodology for purposes of describing these aspects. One of ordinary skill in the art may recognize that further combinations or permutations may be possible. Various methods or constructs may be employed to implement the subject invention, modifications, variations, or equivalents thereof. Accordingly, all such implementations of the aspects described herein are intended to embrace the scope and spirit of subject claims.

In view of exemplary articles of manufacture shown and described herein, methodologies for manufacturing, assembling, and using the one or more disclosed aspects may be implemented in accordance with the disclosed subject matter.

While the foregoing disclosure discusses illustrative aspects and/or embodiments, it should be noted that various changes and modifications could be made herein without departing from the scope of described aspects and/or embodiments as defined by the appended claims. Accordingly, described aspects are intended to embrace all such alterations, modifications, and variations that fall within scope of appended claims. Furthermore, although elements of described aspects and/or embodiments may be described or claimed in the singular, the plural is contemplated unless limitation to the singular is explicitly stated. Additionally, all or a portion of any aspect and/or embodiment may be utilized with all or a portion of any other aspect and/or embodiment, unless stated otherwise.

To the extent that the term "includes" is used in either the detailed description or the claims, such term is intended to be inclusive in a manner similar to the term "comprising" as "comprising" is interpreted when employed as a transitional word in a claim. Furthermore, the term "or" as used in either the detailed description or the claims is intended to mean an inclusive "or" rather than an exclusive "or". That is, unless specified otherwise, or clear from the context, the phrase "X employs A or B" is intended to mean any of the natural inclusive permutations. That is, the phrase "X employs A or B" is satisfied by any of the following instances: X employs A; X employs B; or X employs both A and B. In addition, the articles "a" and "an" as used in this application and the appended claims should generally be construed to mean "one or more" unless specified otherwise or clear from the context to be directed to a singular form.

Additionally, in the subject description, the word "exemplary" (and variants thereof) is used to mean serving as an example, instance, or illustration. Any aspect or design described herein as "exemplary" is not necessarily to be construed as preferred or advantageous over other aspects or designs. Rather, use of the word "exemplary" is intended to present concepts in a concrete manner.

What is claimed is:

1. A closure, comprising:

a lid;

a lower section of the closure operatively attached to the lid by a hinge, the lower section comprising a skirt, wherein the skirt is configured to operatively engage an outer portion of a container adjacent an opening therein;

a surface area formed within the skirt;

a secondary opening formed in the surface area;

a single primary dispensing opening and a shelf area formed within the secondary opening wherein an upper surface of the shelf area is configured to hold dispensed product the lid having an area complimentary to the second opening, such area being substantially the same size and shape as the secondary opening;

the area complimentary to the second opening having a downward extending rim around its perimeter, such rim operating to seal the secondary opening when the lid is closed.

2. The closure of claim 1, wherein the primary dispensing opening is a circular opening.

3. The closure of claim 1, wherein the single primary dispensing opening is a noncircular opening.

4. The closure of claim 1, wherein the shelf area comprises a slot formed inside its perimeter.

5. The closure of claim 4, wherein the at least one slot is smaller than a diameter of the dispensed product.

6. The closure of claim 4, wherein the shelf area comprises a plurality of slots.

7. The closure of claim 1, wherein the skirt has an indented portion.

8. The closure of claim 7, the lid has a lip overhanging the indented portion of the skirt.

9. The closure of claim 1, wherein the single primary dispensing opening is formed within a rim of the secondary opening, and the shelf area is below the rim.

10. The closure of claim 1, further comprising openings around the perimeter for the shelf area.

11. A container assembly, comprising:

a container having an opening for dispensing product; and a closure for sealing the opening, said closure having a skirt for coupling to the exterior of the container adjacent to the opening, the closure further comprising:

a lid having a lower section operatively attached thereto;

a secondary opening formed within the skirt, such opening having an edge and being configured to be sealed by the lid;

a surface area adjacent to the secondary opening;

a shelf area adjacent to the single primary dispensing opening formed within the secondary opening, wherein the shelf area is adjacent to the primary dispensing opening and is configured to hold dispensed product.

12. The container assembly of claim 11, further comprising a secondary opening wherein the single primary dispensing opening and the shelf are formed therein.

13. The container assembly of claim 11, wherein the shelf area comprises a slot that is smaller than a width of dispensed product.

14. The container assembly of claim 11, further comprising openings around the perimeter for the shelf area.

* * * * *